United States Patent [19]

Harrison

[11] 4,337,090

[45] Jun. 29, 1982

[54] HEAT RECOVERABLE NICKEL/TITANIUM ALLOY WITH IMPROVED STABILITY AND MACHINABILITY

[75] Inventor: John D. Harrison, Palo Alto, Calif.

[73] Assignee: Raychem Corporation, Menlo Park, Calif.

[21] Appl. No.: 184,602

[22] Filed: Sep. 5, 1980

[51] Int. Cl.[3] ..... C22C 19/03

[52] U.S. Cl. ..... 148/402; 420/457

[58] Field of Search ..... 75/170; 148/32, 32.5

[56] References Cited

U.S. PATENT DOCUMENTS

| | | | |
|---|---|---|---|
| 3,174,851 | 3/1965 | Buehler et al. . | |
| 3,351,463 | 11/1967 | Rozner et al. . | |
| 3,558,369 | 1/1971 | Wang et al. . | |
| 3,740,839 | 6/1973 | Otte et al. . | |
| 3,753,700 | 8/1973 | Harrison et al. . | |
| 3,832,243 | 8/1974 | Donkersloot et al. . | |
| 4,035,077 | 7/1977 | Harrison et al. . | |
| 4,144,057 | 3/1979 | Melton et al. | 75/170 |
| 4,198,081 | 4/1980 | Harrison et al. . | |

FOREIGN PATENT DOCUMENTS 606456 12/1977 Switzerland .

OTHER PUBLICATIONS

"Nitinols are Nonmagnetic, Corrosion Resistant, Hardenable", Buehler et al., Mater. Des. Eng., pp. 82–83, (Feb. 1962).

"Crystal Structure and a Unique 'Martensitic' Transition of TiNi", Wang et al., J. App. Phys., v. 36, pp. 3232–3239, (1965).

"Homogeneity Range and the Martensitic Transformation of TiNi", Wasilewski et al., Met. Trans., v. 2, pp. 229–238, (1971).

"Effects of Alloying Upon Certain Properties of 55.1 Nitinol", Goldstein et al., NOLTR 64–235, (1965).

"Effects of Additives V, Cr, Mn, Zr on the Transformation Temperature of TiNi Compound", Homma et al., Res. Inst. Min. Dress. Met. Report 622, (1972).

"The Structure of NiTiCu Shape Memory Alloys", Bricknell et al., Met. Trans. A, v. 10A, pp. 693–697, (1979).

"Effect of Alloying on the Critical Points and Hysteresis . . . ", Chernov et al., Dokl. Akad. Nauk SSSR, v. 245, pp. 360–362, (1979), (Translation).

"The Substitution of Cu for Ni in NiTi Shape Memory Alloys", Mercier et al., Met. Trans. A, v. 10A, pp. 387–389, (1979).

"Deformation Behaviour of NiTi-Based Alloys", Melton et al., Met. Trans. A, v. 9A, pp. 1487–1488, (1978).

"The Effect of Opposing Stress on Shape Memory and Martensitic Reversion", Melton et al., Scripta Met., v. 12, pp. 5–9, (1978).

"Zum Aufbau des Systems Ti–Ni–Cu . . . ", Pfeifer et al., J. Less-Common Metals, v. 14, pp. 291–302, (1968).

"Mechanical Properties of TiNi–TiCu Alloys", Erkhim et al., Metal Science & Heat Treatment, v. 20, pp. 652–653, (1978).

*Primary Examiner*—R. Dean

*Attorney, Agent, or Firm*—Derek P. Freyberg

[57] ABSTRACT

Nickel/titanium alloys containing less than a stoichiometric quantity of titanium, which are capable of having the property of heat recoverability imparted thereto at a temperature above the boiling point of liquid nitrogen, may be stabilized by the addition of from 1.5 to 9 atomic percent copper. These stabilized alloys also possess improved workability and machinability.

2 Claims, 2 Drawing Figures

HEAT RECOVERABLE NICKEL/TITANIUM ALLOY WITH IMPROVED STABILITY AND MACHINABILITY

BACKGROUND OF THE INVENTION

1. Field of the Invention

This invention relates to nickel/titanium alloys which are capable of being rendered heat recoverable, and improvements therein.

2. Discussion of the Prior Art

Materials, both organic and metallic, capable of being rendered heat recoverable are well known. An article made of such materials can be deformed from an original, heat-stable configuration to a second, heat-unstable configuration. The article is said to be heat recoverable for the reason that, upon the application of heat alone, it can be caused to revert, or to attempt to revert, from its heat-unstable configuration to its original, heat-stable configuration.

Among metals, the ability to be rendered heat recoverable is a result of the fact that the metal undergoes a reversible transformation from an austenitic state to a martensitic state with a decrease in temperature. An article made from such a metal, for example a hollow sleeve, is easily deformed from its original configuration to a new configuration when cooled below the temperature at which the metal is transformed from the austenitic state to the martensitic state. The temperature at which this transformation begins is usually referred to as the $M_s$ temperature. When an article thus deformed is warmed to the temperature at which the metal starts to revert back to austenite, referred to as the $A_s$ temperature, the deformed object will begin to return to its original configuration.

Heat recoverable metals have found use in recent years in, for example, pipe couplings such as are described in U.S. Pat. Nos. 4,035,077 and 4,198,081 to Harrison and Jervis, and electrical connectors such as those described in U.S. Pat. No. 3,740,839 to Otte and Fischer, the disclosures of which are incorporated by reference herein.

Various alloys of nickel and titanium have in the past been disclosed as being capable of having the property of heat recoverability imparted thereto. Examples of such alloys may be found in U.S. Pat. Nos. 3,174,851 and 3,351,463.

Buehler et al. (Mater. Des. Eng., pp. 82–3 (February 1962); J. App. Phys., v. 36, pp. 3232–9 (1965)) have shown that in the binary Ni/Ti alloys the transformation temperature decreases dramatically and the yield strength increases with a decrease in titanium content from the stoichiometric (50 atomic percent) value. However, lowering the titanium content below 49.9 atomic percent has been found to produce alloys which are unstable in the temperature range of 100° C. to 500° C., as described by Wasilewski et al., Met. Trans., v. 2, pp. 229–38 (1971). The instability (temper instability) manifests itself as a change (generally an increase) in $M_s$ between the annealed alloy and the same alloy which has been further tempered. Annealing here means heating to a sufficiently high temperature and holding at that temperature long enough to give a uniform, stress-free condition, followed by sufficiently rapid cooling to maintain that condition. Temperatures around 900° C. for about 10 minutes are generally sufficient for annealing, and air cooling is generally sufficiently rapid, though quenching in water is necessary for some of the low Ti compositions. Tempering here means holding at an intermediate temperature for a suitably long period (such as a few hours at 200°–400° C.). The instability thus makes the low titanium alloys disadvantageous for shape memory applications, where a combination of high yield strength and low, reproducible $M_s$ is desired.

Certain ternary Ni/Ti alloys have been found to overcome some of these problems. An alloy comprising 47.2 atomic percent nickel, 49.6 atomic percent titanium, and 3.2 atomic percent iron (such as disclosed in U.S. Pat. No. 3,753,700 to Harrison, et al.) has an $M_s$ temperature near −100° C. and a yield strength of about 70,000 psi. While the addition of iron has enabled the production of alloys with both low $M_s$ temperature and high yield strength, this addition has not solved the problem of instability, nor has it produced a great improvement in the sensitivity of the $M_s$ temperature to compositional change.

U.S. Pat. No. 3,558,369 shows that the $M_s$ temperature can be lowered by substituting cobalt for nickel, then iron for cobalt in the stoichiometric alloy. However, although the alloys of this patent can have low transformation temperatures, they have only modest yield strengths (40,000 psi or less).

U.S. Naval Ordinance Laboratory Report NOLTR 64–235 (August 1965) examined the effect upon hardness of ternary additions of from 0.08 to 16 weight percent of eleven different elements to stoichiometric Ni/Ti. Similar studies have been made by, for example, Honma et al., Res. Inst. Min. Dress. Met. Report No. 622 (1972), on the variation of transformation temperature with ternary additions.

U.S. Pat. No. 4,144,057 shows that the addition of copper to Ni/Ti alloys containing traces of at least one other metal produces alloys in which the transformation temperature is relatively less dependent on the composition than it is in the binary alloys. Such a control of transformation temperature is referred to in the '057 patent as "stabilization". This use of "stabilization" should be distinguished from the use made by the present applicant, who, as stated before, uses "stability" to refer to freedom from change of transformation temperature with conditions of manufacture.

Two further requirements for these memory alloys should be noted. These are workability and machinability. Workability is the ability of an alloy to be plastically deformed without crumbling or cracking, and is essential for the manufacture of articles (including even test samples) from the alloy. Machinability refers to the ability of the alloy to be shaped, such as by turning or drilling, economically. Although machinability is not solely a property of the alloy, Ni/Ti alloys are known to be difficult to machine (see, e.g., Machining Data Handbook, 2 ed. (1972) for comparative machining conditions for various alloys), i.e. they are expensive to shape, and a free-machining nickel/titanium memory alloy would be extremely economically attractive.

While U.S. Pat. No. 4,144,057 shows that control of transformation temperature with composition may be achieved by the addition of copper, it does not suggest compositions or conditions which produce alloys having good stability (as defined above), workability, and machinability: all of which properties are important for the economic manufacture of memory metal articles.

In particular, the '057 patent is directed principally towards alloys containing sufficient titanium that ternary addition is not required for temper stability. Further, it fails to distinguish between those elements which are believed to assist in providing temper stability, e.g. Al and Zr, and those which do not, e.g. Co and Fe.

DESCRIPTION OF THE INVENTION

Summary of the Invention

I have discovered that the addition of appropriate amounts of copper to nickel/titanium memory alloys (including but not limited to ternary alloys such as the Ni/Ti/Fe alloys of U.S. Pat. No. 3,753,700) can significantly improve the machinability and temper stability of the alloy without significantly affecting other valuable properties of the alloy such as high yield strength or particular $M_s$ value.

In one aspect, this invention provides memory alloys consisting essentially of nickel, titanium, and copper which display high strength, low transformation temperature, stability, and good workability and machinability. The alloys consist essentially of from 47.5 to 49.7 atomic percent nickel, from 43.5 to 48.8 atomic percent titanium, and the remainder copper.

DETAILED DESCRIPTION OF THE PREFERRED EMBODIMENTS

Figure 1:
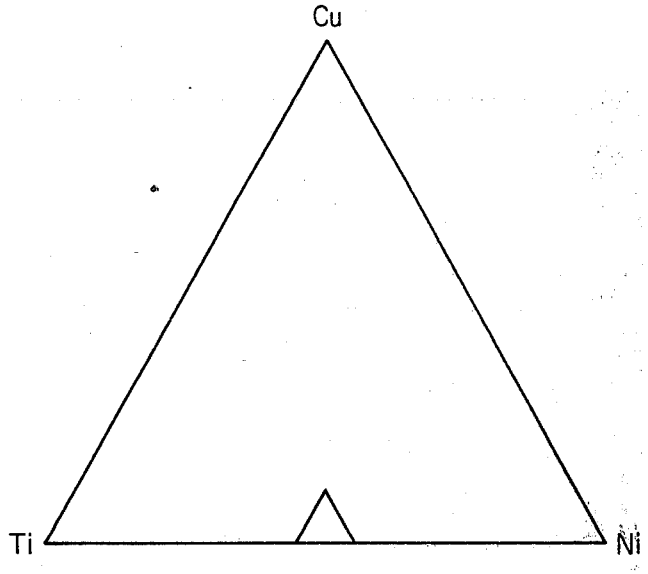
FIG. 1 is the nickel/titanium/copper ternary composition diagram showing the general area of the alloy of this invention.

Memory alloys according to the invention may conveniently be produced by the methods described in, for example, U.S. Pat. No. 3,737,700 and 4,144,057. The following example illustrates the method of preparation and testing of samples of memory alloys.

EXAMPLE

Commercially pure titanium, carbonyl nickel, and OFHC copper were weighed in proportions to give the atomic percentage compositions listed in Table I (the total mass for test ingots was about 330 g). These metals were placed in a water-cooled copper hearth in the chamber of an electron beam melting furnace. The chamber was evacuated to $10^{-5}$ Torr and the charges were melted and alloyed by use of the electron beam. The resulting ingots were hot swaged and hot rolled in air at approximately 850° C. to produce strip of approximately 0.020 in. thickness. After de-scaling, samples were cut from the strip and vacuum annealed at 900° C.

The annealed samples were cooled and re-heated while the change in resistance was measured. From the resistance-temperature plot, the temperature at which the martensitic transformation was complete, the $M_f$ temperature, was determined. The samples were then cooled below $M_f$ and deformed. The deforming force was then released, and the recovery under no load monitored as the temperature was increased. The transformation temperature of each alloy was determined as the temperature at which 50% of the total recovery had occurred, referred to as the $A_{50}$ temperature. The $A_{50}$ temperature is a particularly suitable measure of transformation temperature, since the temperature of transformation is known to be stress-dependent.

After tempering each sample for two hours at 400° C., the tests were repeated. The average of the temperature shift of the resistivity change and of the mid-recovery point, $A_{50}$, for the annealed versus the tempered samples was used as an index of instability: the greater the absolute value of the index, the greater the instability. The yield strength of annealed samples was measured at temperatures high enough to avoid the formation of stress-induced martensite. Values for $A_{50}$, the instability index, and the yield strength are listed in Table 1. On the basis of these data, the preferred composition limits for this invention have been defined.

TABLE I.

| Properties of Nickel/Titanium/Copper Alloys | | | | | |
|---|---|---|---|---|---|
| Atomic Percent | | | Temperature of Mid-Recovery | Instability | Yield |
| Ni | Ti | Cu | ($A_{50}$), °C. | Index | Strength, ksi |
| 51.00 | 49.00 | 0.00 | −57 | 83 | 119 |
| 50.50 | 49.00 | 0.50 | −37 | 38 | 92 |
| 50.00 | 49.00 | 1.00 | −9 | 14 | 77 |
| 50.50 | 48.50 | 1.00 | −106 | 68 | 107 |
| 50.70 | 48.30 | 1.00 | −170 | 94 | 130 |
| 50.00 | 48.50 | 1.50 | −113 | −2 | 105 |
| 49.00 | 49.00 | 2.00 | 6 | −4 | 62 |
| 49.50 | 48.50 | 2.00 | −62 | 1 | 92 |
| 49.90 | 48.10 | 2.00 | −168 | 11 | 117 |
| 48.00 | 49.00 | 3.00 | 22 | −3 | 57 |
| 48.50 | 48.50 | 3.00 | −42 | −3 | 80 |
| 49.10 | 47.90 | 3.00 | −153 | −5 | 115 |
| 48.50 | 47.50 | 4.00 | −87 | 6 | 103 |
| 45.50 | 48.50 | 6.00 | 8 | 4 | 90 |
| 47.00 | 47.00 | 6.00 | −34 | −2 | 119 |

The composition of the alloy of this invention can be described by reference to an area on the nickel, titanium, and copper ternary composition diagram. The general area of the alloy on the composition diagram is shown by the small triangle in FIG. 1. This area of the composition is enlarged and shown in FIG. 2. The compositions at the points A, B, C, D, and E are shown in Table 2 below.

TABLE 2.

| Point | Atomic Percent Composition | | |
|---|---|---|---|
| | Nickel | Titanium | Copper |
| A | 49.7 | 48.8 | 1.5 |
| B | 47.5 | 47.5 | 5.0 |
| C | 47.5 | 43.5 | 9.0 |
| D | 47.5 | 46.0 | 6.5 |
| E | 48.9 | 46.8 | 4.3 |

The lines AB and BC correspond approximately to an $A_{50}$ temperature of −50° C., while the line AC corresponds to the stability limit of these alloys; alloys to the right of the line, or with a lower copper concentration than at point A, are generally unstable with respect to manufacturing conditions.

Figure 2:
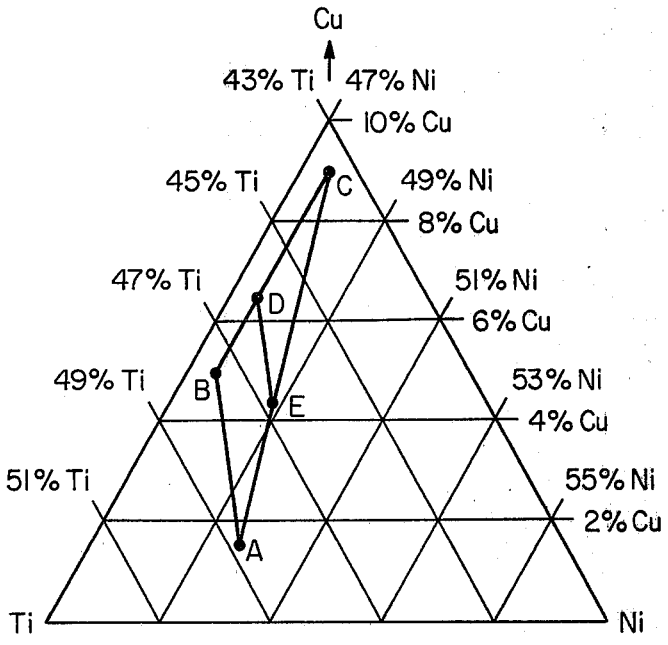
FIG. 2 is an enlargement of a portion of the composition diagram, showing the claimed composition region.

As the extent of thermally recoverable plastic deformation (shape memory) that can be induced in these alloys decreases with decreasing titanium content, the particularly preferred alloys of this invention will lie nearer vertex A (the high titanium vertex) of the triangle ABC of FIG. 2 such as within the quadrilaterial ABDE.

It has been found that the alloys of this invention possess machinability which is unexpectedly considerably better than would be predicted from similar Ni/Ti alloys. While not wishing to be held to any particular theory, it is considered that this free-machining property of the alloys is related to the presence of a second phase, possibly $Ti_2(Ni,Cu)_3$, in the TiNi matrix. It is therefore considered that this improved machinability will manifest itself only when the titanium content is below the stoichiometric value and the Ti:Ni:Cu ratio is such as to favor the formation of the second phase.

In addition to the method described in the Example, alloys according to the invention may be manufactured from their components (or appropriate master alloys) by other methods suitable for dealing with high-titanium alloys. The details of these methods, and the precautions necessary to exclude oxygen and nitrogen either by melting in an inert atmosphere or in vacuum, are well known to those skilled in the art and are not repeated here.

Alloys obtained by these methods and using the materials described will contain small quantities of other elements, including oxygen and nitrogen in total amounts from about 0.05 to 0.2 percent. The effect of these materials is generally to reduce the martensitic transformation temperature of the alloys.

The alloys of this invention possess good temper stability, are hot-workable, and are free-machining; in contrast to prior art alloys. They are also capable of being rendered heat recoverable, and have an $A_{50}$ temperature below −50° C. and above the boiling point of liquid nitrogen.

I claim:

1. A shape memory alloy consisting essentially of nickel, titanium and copper within an area defined on a nickel, titanium, and copper ternary phase diagram by a triangle with its first vertex at 49.7 atomic percent nickel, 48.8 atomic percent titanium, and 1.5 atomic percent copper; its second vertex at 47.5 atomic percent nickel, 47.5 atomic percent titanium, and 5.0 atomic percent copper; and its third vertex at 47.5 atomic percent nickel, 43.5 atomic percent titanium, and 9.0 atomic percent copper, said alloy possessing improved temper stability and machinability and having an $A_{50}$ between −50° C. and −196° C.

2. A shape memory alloy consisting essentially of nickel, titanium and copper within an area defined on a nickel, titanium, and copper ternary phase diagram by a quadrilateral with its first vertex at 49.7 atomic percent nickel, 48.8 atomic percent titanium, and 1.5 atomic percent copper; its second vertex at 47.5 atomic percent nickel, 47.5 atomic percent titanium, and 5.0 atomic percent copper; its third vertex at 47.5 atomic percent nickel, 46.0 atomic percent titanium, and 6.5 atomic percent copper; and its fourth vertex at 48.9 atomic percent nickel, 46.8 atomic percent titanium, and 4.3 atomic percent copper, said alloy possessing improved temper stability and machinability and having an $A_{50}$ between −50° C. and −196° C.

* * * * *